US008205343B2

(12) United States Patent
Winter et al.

(10) Patent No.: US 8,205,343 B2
(45) Date of Patent: Jun. 26, 2012

(54) SAFETY RAZOR HAVING PIVOTABLE BLADE UNIT

(75) Inventors: John Joseph Winter, Wokingham (GB); Terence Gordon Royle, Basingstoke (GB)

(73) Assignee: The Gillette Company, Boston, MA (US)

( * ) Notice: Subject to any disclaimer, the term of this patent is extended or adjusted under 35 U.S.C. 154(b) by 381 days.

(21) Appl. No.: 12/485,309

(22) Filed: Jun. 16, 2009

(65) Prior Publication Data

US 2009/0313837 A1 Dec. 24, 2009

Related U.S. Application Data

(60) Provisional application No. 61/132,494, filed on Jun. 19, 2008.

(51) Int. Cl.
*B26B 21/52* (2006.01)

(52) U.S. Cl. ..... 30/527; 30/50; 30/532

(58) Field of Classification Search ..... 30/47, 50, 30/57, 527, 529, 532, 533
See application file for complete search history.

(56) References Cited

U.S. PATENT DOCUMENTS

| | | | | |
|---|---|---|---|---|
| 831,259 | A * | 9/1906 | Bingler | 30/63 |
| 1,455,751 | A * | 5/1923 | Hartman | 30/529 |
| 1,639,441 | A * | 8/1927 | Spahr | 30/529 |
| 3,950,848 | A | 4/1976 | Goldstein | |
| 3,964,160 | A | 6/1976 | Gordon | |
| 4,275,498 | A | 6/1981 | Ciaffone | |
| 4,347,663 | A * | 9/1982 | Ullmo | 30/47 |
| 5,029,391 | A | 7/1991 | Althaus et al. | |
| 5,093,991 | A | 3/1992 | Hendrickson | |
| 5,526,568 | A | 6/1996 | Copelan | |
| 5,535,518 | A | 7/1996 | Althaus | |
| 5,560,106 | A * | 10/1996 | Armbruster et al. | 30/527 |
| 5,787,593 | A | 8/1998 | Althaus | |
| 5,953,824 | A | 9/1999 | Ferraro et al. | |
| 6,115,924 | A | 9/2000 | Oldroyd | |
| 6,301,786 | B1 * | 10/2001 | Oswald et al. | 30/43.92 |
| 6,311,400 | B1 | 11/2001 | Hawes et al. | |
| 6,381,857 | B1 | 5/2002 | Oldroyd | |
| 6,615,498 | B1 | 9/2003 | King et al. | |
| 7,137,205 | B2 | 11/2006 | Royle | |
| 7,140,116 | B2 * | 11/2006 | Coffin | 30/531 |
| 7,461,456 | B2 * | 12/2008 | Tsushio et al. | 30/43.92 |
| 2009/0313837 | A1 * | 12/2009 | Winter et al. | 30/527 |
| 2010/0043242 | A1 * | 2/2010 | Stevens | 30/527 |
| 2010/0313426 | A1 * | 12/2010 | Royle | 30/57 |
| 2011/0035950 | A1 * | 2/2011 | Royle | 30/532 |

* cited by examiner

*Primary Examiner* — Hwei C Payer
(74) *Attorney, Agent, or Firm* — John M. Lipchitz; Kevin C. Johnson; Steven W. Miller

(57) ABSTRACT

A safety razor includes a handle and a blade unit having at least one blade. The blade unit is connected to the handle for a pivotal movement relative thereto. One of the handle and the blade unit has a concave portion formed on its surface. A relative movement transfer member is formed between the handle and the blade unit for transferring a relative movement between the handle and the blade unit caused by the pivotal movement. A return force generating member is formed in the concave portion for generating a return force for the blade unit in response to the relative movement transfer member. The return force generating member includes a holding structure for holding a part of the relative movement transfer member, and an elastic member connected to the holding structure for generating the return force in response to the relative movement transfer member.

11 Claims, 15 Drawing Sheets

SAFETY RAZOR HAVING PIVOTABLE BLADE UNIT

CROSS REFERENCE TO RELATED APPLICATION

This application claims the benefit of U.S. Provisional Application No. 61/132,494, filed on Jun. 19, 2008.

FIELD OF THE INVENTION

The present invention relates to safety razors including a handle and a blade unit having at least one blade. More particularly, the present invention relates to a safety razor having the blade unit being connected to the handle for a pivotal movement relative thereto about a pivot axis substantially perpendicular to the blade for following the skin contours of a user during shaving.

BACKGROUND OF THE INVENTION

Conventional safety razors have a blade unit connected to a handle for a pivotal movement about a single pivotal axis which is substantially parallel to the blade (i.e., the blade edge). The pivotal movement about the single axis provides some degree of conformance with the skin allowing the blade unit to easily follow the skin contours of a user during shaving. The pivot axis, which usually extends parallel to the cutting edges of the blades, can be defined by a pivot structure where the handle is connected to the blade unit. Such safety razors have been successfully marketed for many years. However, the blade unit often disengages from the skin during shaving as it has limited ability to pivot about the single axis.

To address this problem, it was suggested that the blade unit can additionally pivot about another axis which is substantially perpendicular to the blade(s). For example, U.S. Pat. No. 5,029,391 discloses such a razor having a blade unit capable of a pivotal movement about a pivot axis substantially perpendicular to the blade(s). It is disclosed that the blade unit can carry out a pivoting movement about two axes, so that the safety razor blade unit can optimally conform to the contour of the face during shaving. Other examples of safety razors which have a blade unit capable of pivotal movements about two pivot axes are disclosed in U.S. Pat. Nos. 6,615,498; and 5,953,824; and Japanese Patent Laid Open Publication Nos. H2-34193; H2-52694; and H4-22388.

While it is disclosed that these razors help the blade unit to more suitably follow the skin contours of a user, they tend to have a complicated structure to implement the pivotal movements about two pivot axes and thus cause a difficulty in manufacturing.

Thus, there is a need for a safety razor having a blade unit capable of a pivotal movement about a pivot axis substantially perpendicular to the blade, which can be produced by a simplified manufacturing process. There is also a need for a safety razor having a blade unit capable of pivotal movements about two pivot axes, which can be produced by a simplified manufacturing process.

SUMMARY OF THE INVENTION

The invention is directed to a safety razor which includes a handle and a blade unit having at least one blade. The blade unit is connected to the handle for a pivotal movement relative thereto about a perpendicular pivot axis which is substantially perpendicular to the at least one blade for following the skin contours of a user during shaving. The blade unit has a rest position towards which the blade unit is biased by a return force when pivoted about the perpendicular pivot axis away from the rest position.

In one aspect, one of the handle and the blade unit has a concave portion formed on its surface. The safety razor further includes: (a) a relative movement transfer member formed between the handle and the blade unit for transferring a relative movement between the handle and the blade unit caused by the pivotal movement, and (b) a return force generating member formed in the concave portion for generating a return force for the blade unit in response to the relative movement transfer member. The return force generating member includes (i) a holding structure for holding a part of the relative movement transfer member, and (ii) an elastic member connected to the holding structure for generating the return force in response to the relative movement transfer member.

In this aspect, since the return force generating member is held in the concave portion which is formed on the surface of the handle or the blade unit, the safety razor can be produced by a simplified manufacturing process.

In another aspect, the safety razor further includes: (a) a relative movement transfer member formed on the perpendicular pivot axis for transferring a relative movement between the handle and the blade unit caused by the pivotal movement, and (b) a return force generating member formed on the perpendicular pivot axis for generating a return force for the blade unit in response to the relative movement transfer member. The relative movement is given by a rotation angle difference about the perpendicular pivot axis, while the return force is given by a torque about the perpendicular pivot axis.

In this aspect, since the relative movement transfer member and the return force generating member are formed on a common axis, the structure of the safety razor can be simplified.

BRIEF DESCRIPTION OF THE DRAWINGS

While the specification concludes with claims particularly pointing out and distinctly claiming the subject matter which is regarded as forming the present invention, it is believed that the invention will be better understood from the following description taken in conjunction with the accompanying drawings.

DETAILED DESCRIPTION OF THE INVENTION

Herein, "comprise" and "include" mean that other elements and/or other steps which do not affect the end result can be added. Each of these terms encompasses the terms "consisting of" and "consisting essentially of".

Herein, "connected" encompasses configurations in which an element is directly secured or mounted to another element by affixing the element directly to the other element; configurations in which the element is indirectly secured or mounted to the other element by affixing the element to an intermediate member which is affixed to the other element; and configurations in which one element is integral with another element, i.e., one element is essentially part of the other element.

Figure 1:
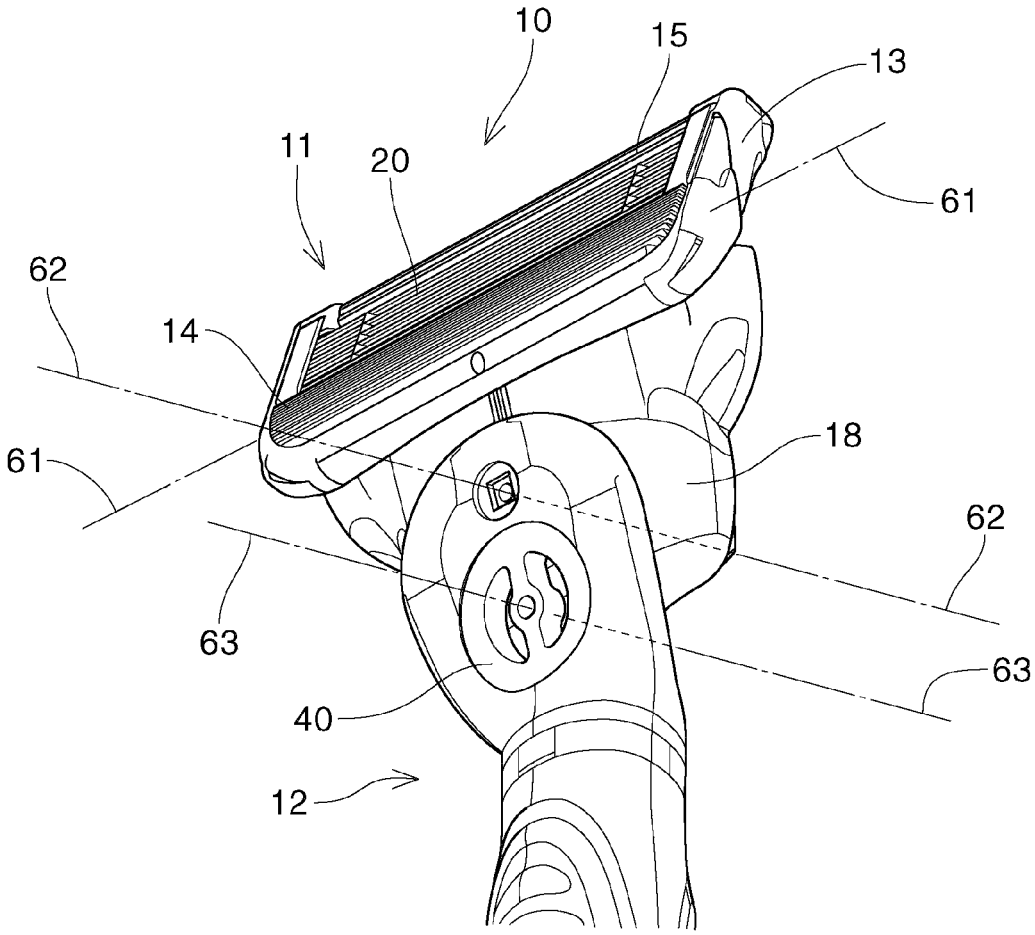
FIG. 1 is a perspective view of a safety razor which is one embodiment of the present invention.

FIG. 1 is a perspective view of a safety razor 10 which is one embodiment of the present invention. Referring to FIG. 1, the safety razor 10 includes a blade unit 11 and a handle 12. The blade unit 11 includes a frame 13 with a guard 14, a cap 15, and a plurality of blades 20 positioned between the guard 14 and cap 15 with their cutting edges parallel to each other, as well known in the art. The blade unit 11 includes a connecting member 18 which connects the blade unit 11 with the handle 12.

The blade unit 11 is connected to the handle 12 for movement relative thereto about a first pivot axis (or, "parallel pivot axis") 61 which is substantially parallel to the edges of the blades 20. More specifically, the blade unit 11 is connected to the connecting member 18 and is pivotally moveable about the first pivot axis 61. The first pivot axis 61 is preferably in front of the blades and below a plane tangential to the guard 14 and cap 15 surfaces, although other pivot positions are possible. In other words, the blade unit 11 pivots about the first pivot axis 61 in response to the force applied from the skin and the return force during shaving.

The return force generated by the springs can be either linear or non-linear acting to return the blade unit 11 to the rest position. The torque range of the return force is from about 0 to about 15 Nmm as the blade unit 11 pivots from its rest position about the first pivot axis 61 through the complete pivot range. Other torque ranges both larger and smaller may be used as desired. The torque can be varied by varying the physical property of the springs used. Preferably, the blade unit 11 has a pivot range up to about 45° about the first pivot axis 61. Other pivot ranges both larger and smaller may be used as desired.

The blade unit 11 is also connected to the handle 12 for a pivotal movement relative thereto about a second pivot axis (or, "perpendicular pivot axis") 62 which is substantially perpendicular to the blades 20 for following the skin contours of a user during shaving. The handle 12 is pivotally connected to the connecting member 18 about the second pivot axis 62. The connecting member 18 (which is a part of the blade unit 11) has a rest position towards which the connecting member 18 is biased by a return force when pivoted about the second pivot axis 62 away from the rest position.

The second pivot axis 62 is substantially perpendicular to the handle axis (not shown in Figs. but it coincides with the central axis of the handle 12). If desired, the second pivot axis 62 can be set between 5 degrees and 30 degrees from a virtual plane (not shown in Figs.) which is perpendicular to the handle axis. In one embodiment, the second pivot axis 62 is set at 18 degrees from the virtual plane.

Figure 2:
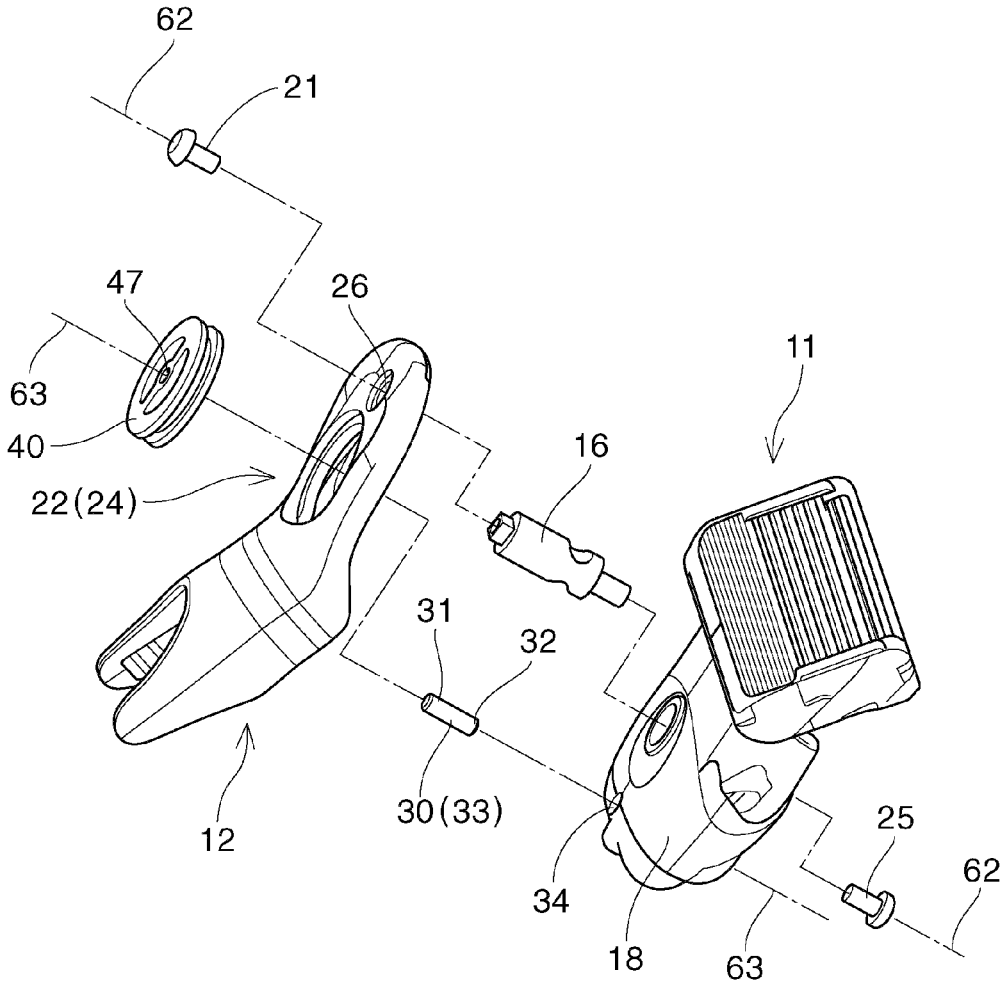
FIG. 2 is an exploded perspective view of a subassembly of the safety razor shown in FIG. 1.

In the embodiment shown in FIG. 1, there is a concave portion 22 formed on the surface of the handle 12 (not shown in FIG. 1 but FIG. 2). Alternatively, the blade unit 11 can have such a concave portion formed on its surface (not shown in Figs.).

FIG. 2 is an exploded perspective view of a subassembly of the safety razor 10 shown in FIG. 1. The safety razor 10 further includes an attachment member 16. The attachment member 16 is inserted into a hole 26 formed in the handle 12 and secured to the handle 12 via a pin 21. The attachment member 16 is also pivotally attached to the connecting member 18 and retained by a pin 25. The attachment member 16 and the pins 21 and 25 are disposed along the second pivot axis 62. One structure which pivotally couples the blade unit 11 and the handle 12 is disclosed in U.S. Pat. No. 5,787,586.

The safety razor 10 further includes: (a) a relative movement transfer member 30 formed between the handle 12 and the blade unit 11; and (b) a return force generating member 40 formed in the concave portion 22. The relative movement transfer member 30 transfers a relative movement between the handle 12 and the blade unit 11 which is caused by the pivotal movement about the second pivot axis 62, to the return force generating member 40. The return force generating member 40 generates a return force for the blade unit 11 in response to the relative movement transfer member 30. The relative movement transfer member 30 typically includes a rod-like shaped member (e.g., a shaft) which couples the handle 12 to the blade unit 11.

The blade unit 11 has a third (or movable) axis 63 which is movable in response to the relative movement between the handle 12 and the blade unit 11 while it (i.e., the third axis 63) is being kept parallel to the second axis 62. In the embodiment shown in FIGS. 1 and 2, when the blade unit 11 pivots about the second pivot axis 62 for following the skin contours of a user during shaving, the third axis 63 moves (or shifts) in response to the force applied through the relative movement transfer member 30.

Referring to FIG. 2, the relative movement transfer member 30 includes a shaft 33 having a first end 31 inserted into a round hole 47 of the return force generating member 40 and a second end 32 inserted into a hole 34 of the blade unit 11. The hole 47 of the return force generating member 40 has an opening shape which is designed to hold the first end 31 of the relative movement transfer member 30. The shaft 33 transfers a relative movement between the handle 12 and the blade unit 11 which is caused by the pivotal movement about the second pivot axis 62, to the return force generating member 40. The relative movement transfer member 30 (or the shaft 33) and the holes 34 and 47 are disposed along the third axis 63 which is parallel to the second axis 62.

The return force generating member 40 is formed in the concave portion 22 formed on the surface of the blade unit 11 or the handle 12. The concave portion 22 can take any shape formed on the surface of the blade unit 11 (including the blade unit 11) or the handle 12. Herein, "concave portion" refers to a portion of the handle or the blade unit formed on its surface, which has a shape and a depth to hold (or house) at least a part of (and preferably the most or entire part of) the return force generating member. Herein, "surface of a handle or a blade unit" is a part of the handle or the blade unit which is exposed to (i.e., can be seen from) the outside before the blade unit is connected to the handle in the manufacturing process. Since the return force generating member is held in the concave portion which formed on the surface of the handle or the blade unit, the safety razor can be produced by a simplified manufacturing process, compared to implementing such a function by mechanical elements (e.g., springs).

In one embodiment, the concave portion provides enough space to house the return force generating member. For example, the concave portion 22 has a slightly larger dimension than that of the return force generating member 40 to house the entire return force generating member 40. The concave portion is typically formed below the adjacent surface(s) of the handle and the blade unit but alternatively, it can be formed above the adjacent surface(s) of the handle and the blade.

In another embodiment, the concave portion of one of the handle and the blade unit faces (or is exposed to) a part of the other of the handle and the blade unit. In the embodiment shown in FIG. 2, the concave portion 22 of the handle 12 faces a part of the blade unit 11. The concave portion 22 can include a hole formed in a part of the handle or the blade unit, which penetrates the surfaces at that part. In the embodiment shown in FIG. 2, the concave portion 22 is formed by a hole 24 formed in a part of the handle 12, which penetrates the surfaces of the handle 12 at that part. Since the return force generating member 40 is held in the concave portion which formed on the surface of the handle, the safety razor 10 can be produced by a simplified manufacturing process.

Figure 3:
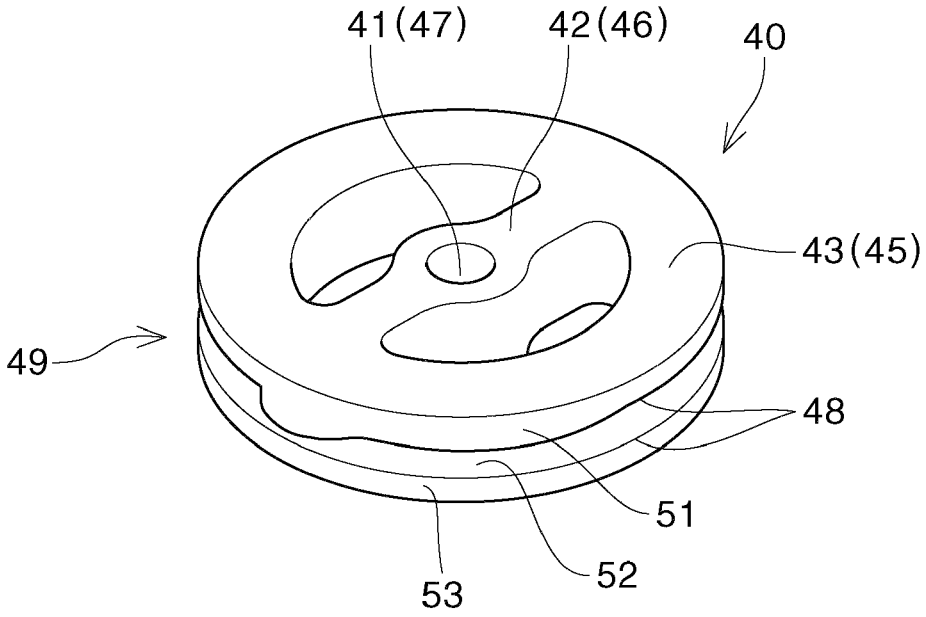
FIG. 3 is a perspective view of the return force generating member shown in FIG. 1.

FIG. 3 is a perspective view of the return force generating member 40 shown in FIG. 1. The return force generating member 40 includes (i) a holding structure 41 for holding the first end 31 of the relative movement transfer member 30, and (ii) an elastic member 42 connected to the holding structure 41 for generating the return force in response to the relative movement transfer member 30. The return force generating member 40 further includes (iii) an outer support 43 formed in the concave portion 22. The holding structure 41 and the elastic member 42 are formed in the outer support 43. The outer support 43 includes an outer frame 45 which supports the elastic member 42. The elastic member 42 includes at least one elastomeric element (or bar) 46 formed between the outer frame 45 and the holding structure 41. In the embodiment shown in FIG. 3, the elastic member 42 includes two elastomeric bars 46 each formed between the outer frame 45 and the holding structure 41. In other words, if desired, the elastic member 42 can include a plurality of elastomeric elements (or bars) 46 each formed between the outer frame 45 and the holding structure 41.

The holding structure 41 of the return force generating member 40 can take any shape or structure which can receive the relative movement transmitted from the relative movement transfer member 30. In the embodiment shown in FIG. 3, the holding structure 41 has a round hole 47 which is formed at the center of the return force generating member 40 and has dimensions suitable for holding the first end 31 of the relative movement transfer member 30 by insertion. The shape of the hole 47 can vary depending on the shape or structure of the first end 31 of the relative movement transfer member 30, for example, it can be a circular shape, a rectangular shape, a polygonal shape, or the like.

In the embodiment shown in FIG. 3, the return force generating member 40 has grooves 48 formed on its side surface 49. The grooves 48 can increase friction on the side surface 49 of the return force generating member 40 thereby preventing the return force generating member 40 from rotating (or moving) in the concave portion 22.

The return force generating member 40 (i.e., at least the elastic member 42 or the elastomeric elements 46) is formed by an elastomeric material. Such an elastomeric material can include synthetic or natural rubber materials. One example of such an elastomeric material for use herein is a polyether-based thermoplastic elastomer (TPE) which is available from Kraiburg HTP under Code No. 1028/55. Another example of such an elastomeric material for use herein is a polyether-based thermoplastic vulcanizate elastomer (TPVs) which is available from Exxon Mobil Corporation under Code No. Santoprene™ 101-55/201-55.

In one embodiment, the outer support 43, the elastic member 42 (or the elastomeric elements 46) and the outer support 43 are formed by an identical material. The physical property of the elastic member 42 can vary depending on the dimensions of the elastic member 42 or the elastomeric material selected. Alternatively, the outer support 43, the elastic member 42 (or the elastomeric elements 46) and the outer support 43 can be formed by different materials.

In the embodiment shown in FIG. 3, the return force generating member 40 is formed by an identical material. Specifically, all the component members of the return force generating member 40 (i.e., the outer support 43, the elastic member 42 and the outer support 43) are formed by an identical material.

The return force generating member 40 can take a layered structure formed by two (or more) different elastomeric materials. Herein, "different elastomeric materials" refers to two (or more) materials which have different elastic characteristics (e.g., elasticity). The different elastomeric materials do not have to be formed by two (or more) materials but can be formed by an identical elastomeric material by selecting different physical parameters on each layer (i.e., thickness, density, etc.).

In the embodiment shown in FIG. 3, for example, the return force generating member 40 includes a layered structure 50 formed by three layers 51-53 wherein the top and bottom layers 51 and 53 are formed by an identical elastomeric material while the middle layer 52 is formed by a different elastomeric material. In such a layered structure 50, the elastic characteristics of the return force generating member 40 can be controlled by controlling the thickness of each layer 51-53 and/or selecting the ingredient materials to be used in each layer 51-53.

Figure 4:
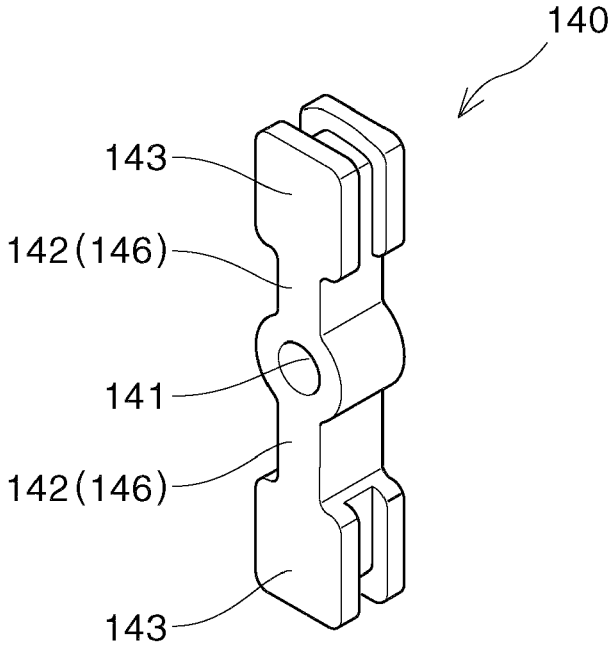
FIG. 4 is a perspective view of a return force generating member which is used in another embodiment of the invention.

FIG. 4 is a perspective view of a return force generating member 140 which is another embodiment of the invention. The return force generating member 140 includes (i) a holding structure 141 for holding the first end 31 of the relative movement transfer member 30, and (ii) an elastic member 142 connected to the holding structure 141 for generating the return force in response to the relative movement transfer member 30. The return force generating member 140 further includes (iii) an outer support 143 which supports the elastic member 142. The elastic member 142 includes two elastomeric elements (or bars) 146 each formed between the outer support 143 and the holding structure 141.

FIGS. 18-24 are a perspective view of a return force generating member which can used in other embodiments of the invention. In FIGS. 18-24, each return force generating member 740 includes (i) a holding structure 741, (ii) an elastic member 742, and (iii) an outer support 743 which supports the elastic member 742. The basic functions of each return force generating member 740 and its elements 741-743 are common and similar to those of the return force generating member 40 and 140 shown in FIGS. 3 and 4.

Figure 5:
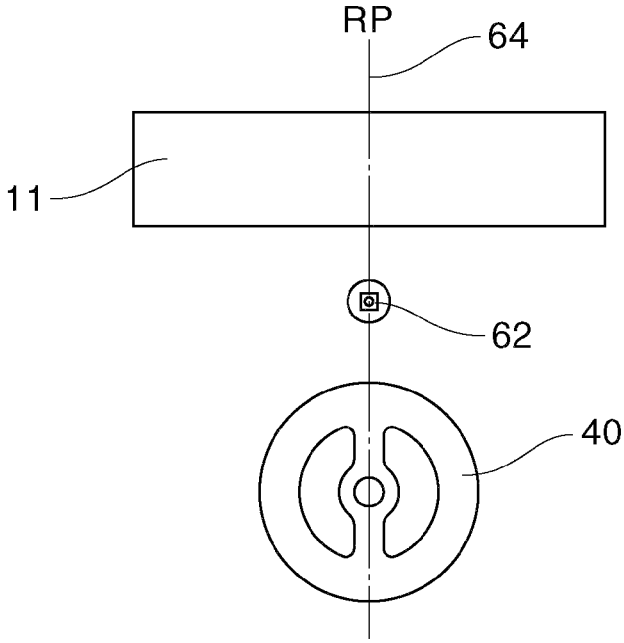
FIGS. 5 and 6 are schematic drawings which explain the function of the return force generating member shown in FIG. 1.
Figure 6:
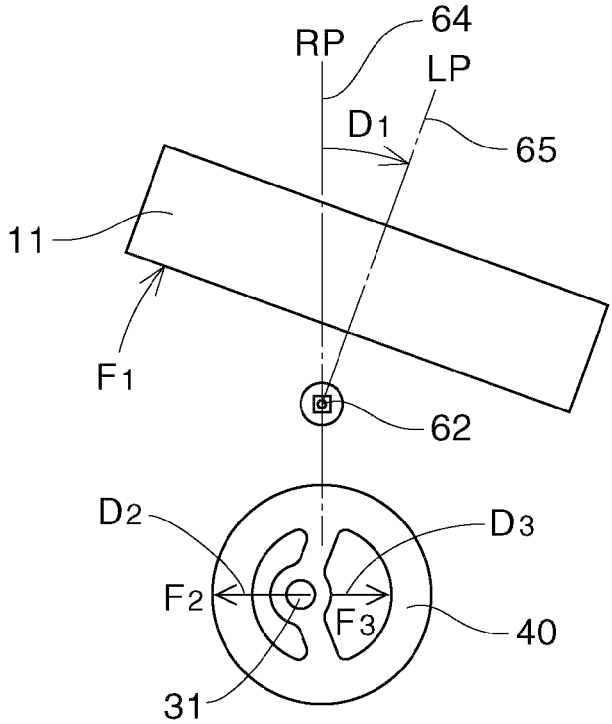

FIGS. 5 and 6 are schematic drawings which explain the function of the return force generating member 40 shown in FIG. 1. These drawings illustrate the relative movements between the blade unit 11 and the return force generating member 40 when the blade unit 11 pivots about the second pivot axis 62 for following the skin contours of a user during shaving. In these drawings, the blade unit 11 has a pivot axis 64 which shows the degree of its lean from the rest position RP. The pivot axis 64 is perpendicular to the second axis 62.

In FIG. 5, since no force is applied from the skin before shaving starts, the blade unit 11 is in the rest position RP and thus the pivot axis 64 is in the rest position RP. In this state, the blade unit 11 is ready for being biased by a return force generated by the return force generating member 40 if it pivots about the second pivot axis 62 away from the rest position RP.

In FIG. 6, after shaving starts, the blade unit 11 receives a force F1 which is applied from the skin and thus it leans in the direction D1 to reach the lean position LP which is indicated by the moved central axis 65 in FIG. 6. In response to this lean, the end portion 31 of the relative movement transfer member 30 (not shown in FIG. 6) pushes the elastic member 42 (or the elastomeric elements 46) with a force F2 in the direction D2, and thus a reaction force is generated as a return force F3 in the direction D3 by the elastic member 42. This return force F3 is transmitted via the relative movement transfer member 30 (not shown in FIG. 6), thereby pushing back the blade unit 11 to the rest position RP.

Similarly, the blade unit 11 and the return force generating member 40 work when the opposite force (to the force F1) is applied to the blade unit 11 from the skin during shaving.

The return force generated by the return force generating member 40 can be either linear or non-linear acting to return the blade unit 11 to the rest position RP. The torque range can be from about 0 to about 15 Nmm as the blade unit 11 pivots from its rest position RP about the second pivot axis 62 in either direction through the complete pivot range. Other torque ranges both larger and smaller may be used as desired. The torque can be varied depending on the elastic property of the return force generating member 40 used. In the embodiment shown in FIG. 1, the torque range is from about 0 to about 15 Nmm.

The blade unit 11 can have a pivot range (about the second pivot axis 62) up to about 15° in either direction from the rest position. Other pivot ranges both larger and smaller may be used as desired. In the embodiment shown in FIG. 1, the blade unit 11 can have a pivot range about 15° in either direction from the rest position.

Since the blade unit 11 can carry out a pivoting movement about the two axes 61 and 62, the safety razor blade unit 12 can optimally conform to the contour of the face during shaving.

Figure 7:
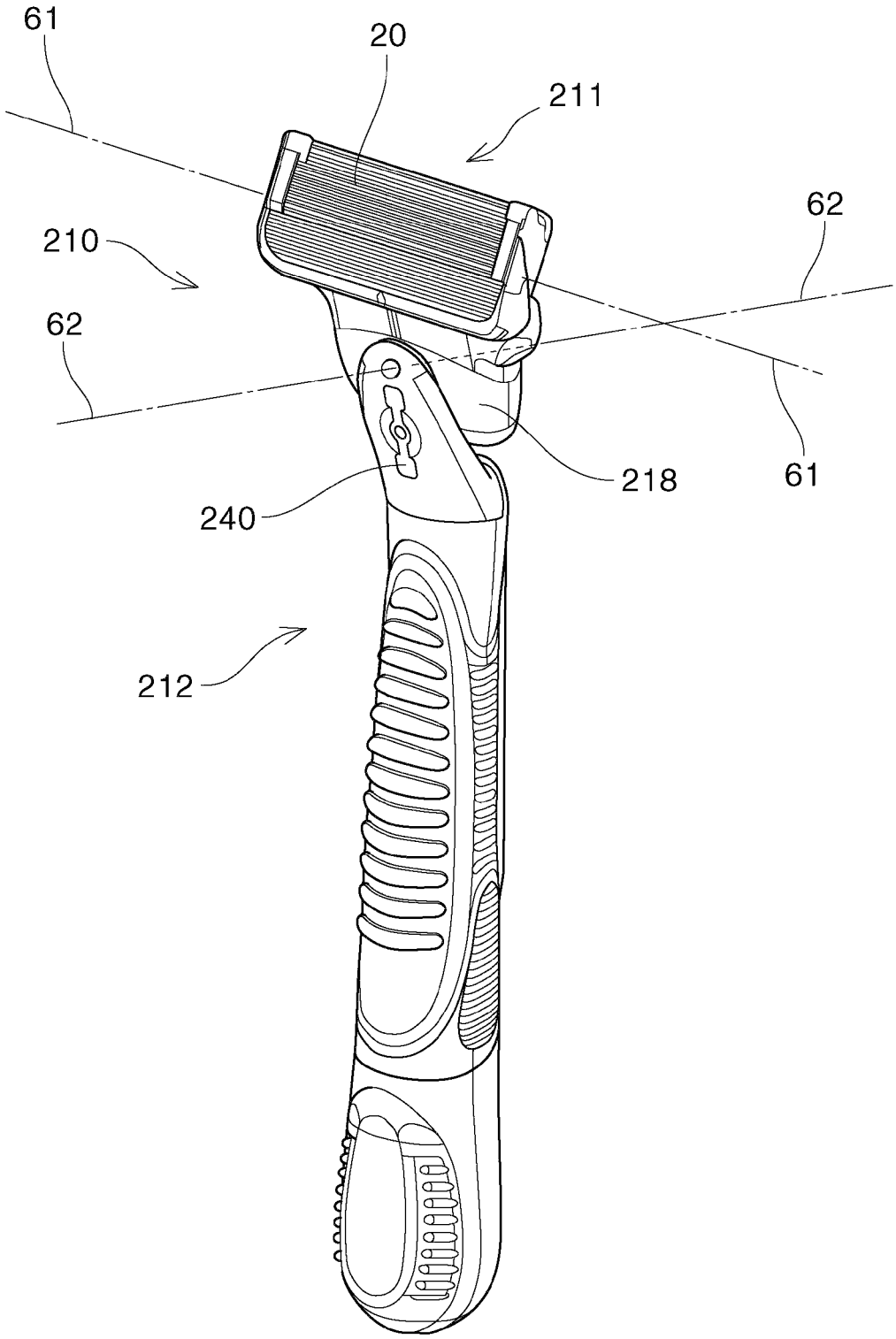
FIG. 7 is a perspective view of a safety razor which is yet another embodiment of the present invention.
Figure 8:
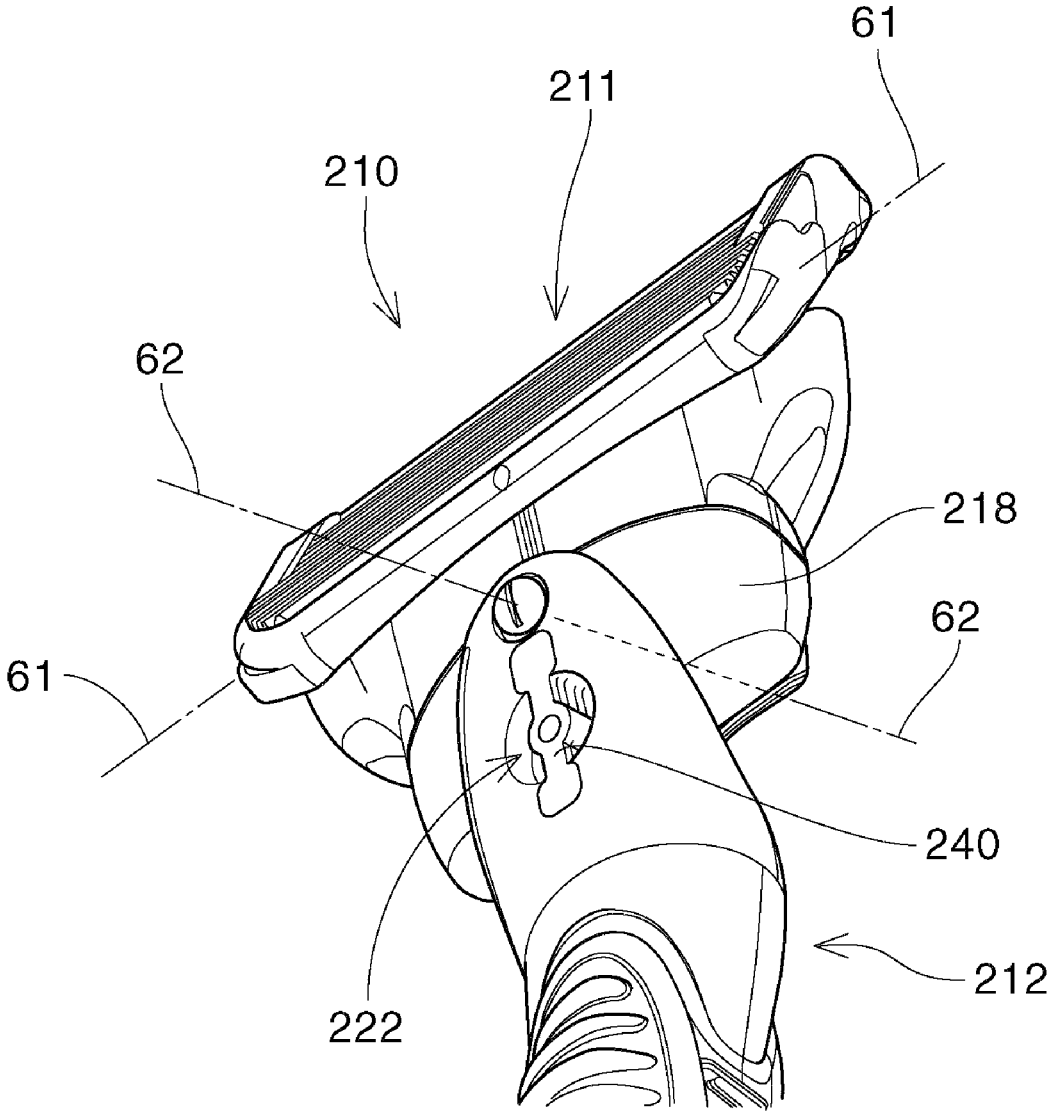
FIG. 8 is a perspective view of the upper portion of the safety razor shown in FIG. 7.

FIGS. 7-8 show another embodiment of the safety razor of the invention. This safety razor 210 is similar to the safety razor 10 shown in FIG. 1 except the return force generating member 240.

Referring to FIG. 7, the safety razor 210 includes a blade unit 211 which is connected to a handle 212 (through a connecting member 218) for a pivotal movement relative thereto about the second pivot axis 62 which is substantially perpendicular to the blades 20 for following the skin contours of a user during shaving. The blade unit 211 has a rest position towards which the blade unit 211 is biased by a return force when pivoted about the second pivot axis 62 away from the rest position. In the embodiment shown in FIG. 7, the handle 212 has a concave portion 222 (not shown in FIG. 7 but FIG. 8) formed on its surface. Alternatively, the blade unit 211 can have a concave portion formed on its surface (not shown in Figs.).

FIG. 8 is a perspective view of the upper portion of the safety razor 210 shown in FIG. 7. The safety razor 210 further includes the return force generating member 240 formed in the concave portion 222. The relative movement transfer member (not shown in FIG. 8) transfers a relative movement between the handle 212 and the blade unit 211 (through the connecting member 218) which is caused by the pivotal movement about the second pivot axis 62, to the return force generating member 240. The handle 212 is connected to the connecting member 218 through the attachment member 16 (not shown in FIG. 8) as depicted in the subassembly shown in FIG. 2. The return force generating member 240 generates a return force for the blade unit 211 in response to the relative movement transfer member. The return force generating member 140 shown in FIG. 4 can be used as the return force generating member 240 in FIG. 8.

Figure 9:
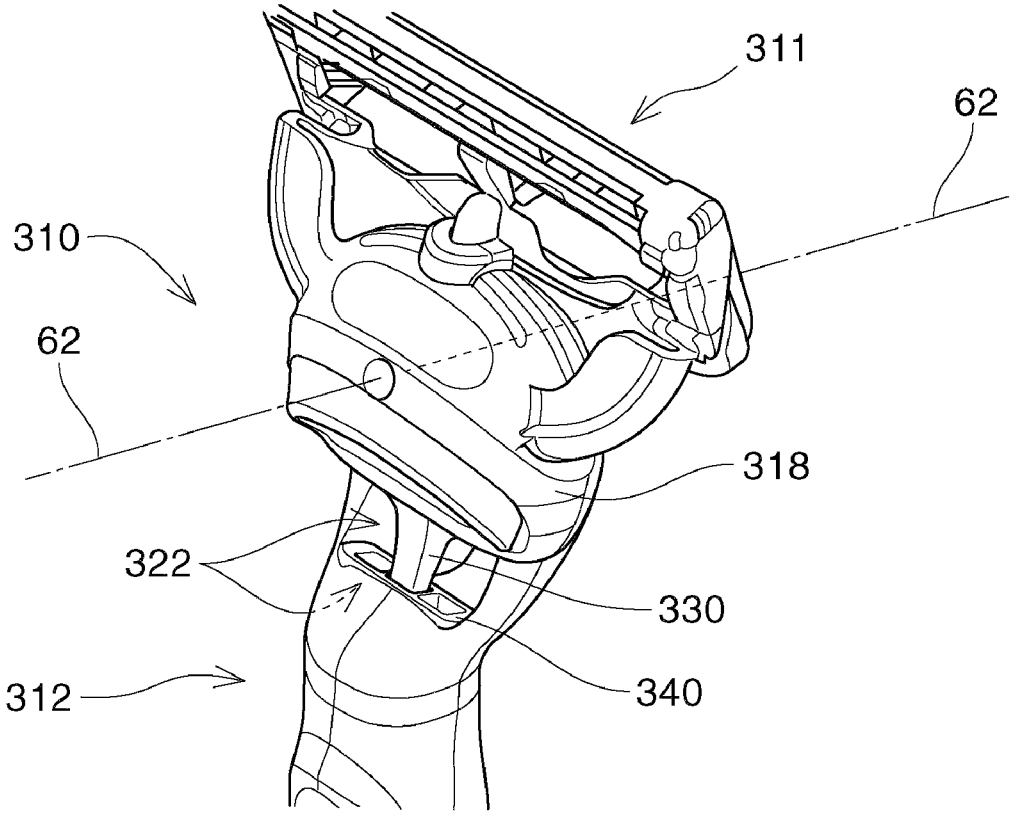
FIG. 9 is a perspective view of a safety razor which is a still another embodiment of the present invention.
Figure 10:
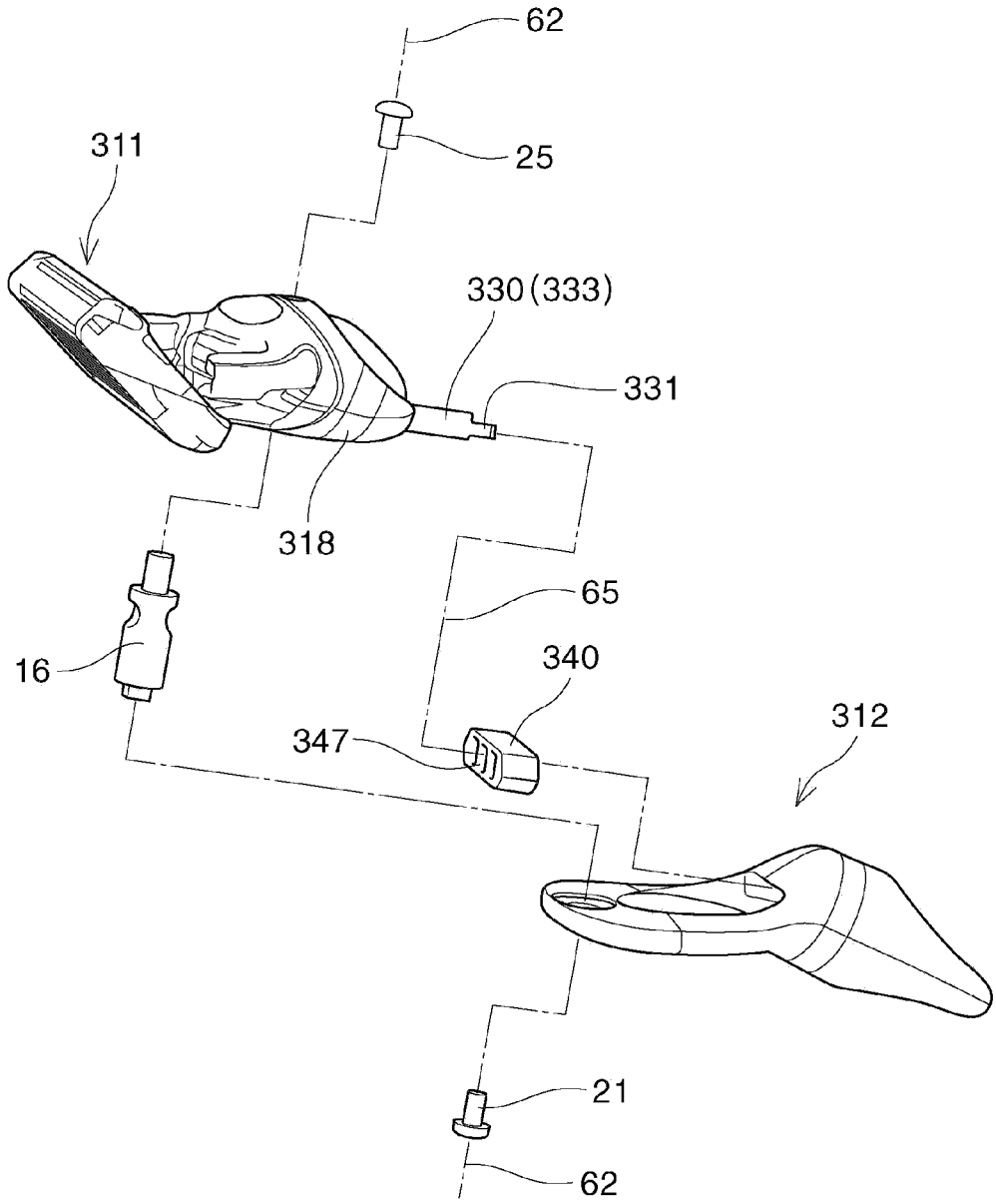
FIG. 10 is an exploded perspective view of a subassembly of the safety razor shown in FIG. 9.
Figure 11:
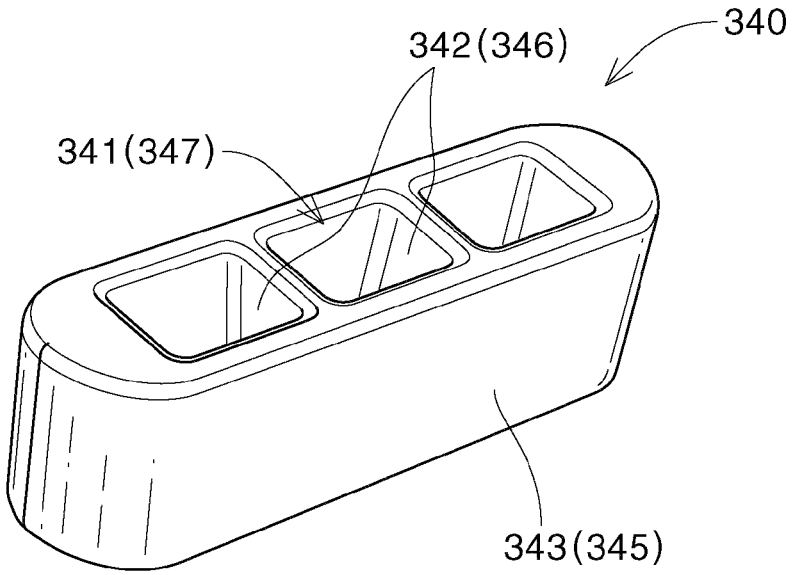
FIG. 11 is a perspective view of the return force generating member shown in FIG. 9.

FIGS. 9-11 show yet another embodiment of the safety razor of the invention. Referring to FIG. 9, the safety razor 310 includes a blade unit 311 which is connected to a handle 312 (through a connecting member 318) for a pivotal movement relative thereto about the second pivot axis 62 which is substantially perpendicular to the blades (not shown in FIG. 9) for following the skin contours of a user during shaving. The blade unit 311 has a rest position towards which the blade unit 311 is biased by a return force when pivoted about the second pivot axis 62 away from the rest position. In the embodiment shown in FIG. 9, the handle 312 has a concave portion 322 formed on its surface. Alternatively, the blade unit 311 can have a concave portion formed on its surface (not shown in Figs.).

The safety razor 310 further includes: (a) a relative movement transfer member 330 formed between the handle 312 and the blade unit 311; and (b) a return force generating member 340 formed in the concave portion 322. The relative movement transfer member 330 transfers a relative movement between the handle 312 and the blade unit 311 (through the connecting member 318) which is caused by the pivotal movement about the second pivot axis 62, to the return force generating member 340. The return force generating member 340 generates a return force for the blade unit 311 in response to the relative movement transfer member 330. The relative movement transfer member includes a rod-like shaped member (not shown in FIG. 9 but FIG. 11) which couples the handle 312 to the blade unit 311.

FIG. 10 is an exploded_perspective view of a subassembly of the safety razor 310 shown in FIG. 9. The safety razor 310 further includes an attachment member 16. The attachment member 16 is pivotally attached to the handle 12 via a pin 21. The attachment member 16 is also pivotally attached to the connecting member 318 via a pin 25. The attachment member 16 and the pins 21 and 25 are disposed along the second pivot axis 62.

The blade unit 311 has a third (or movable) axis 65 which direction is movable in response to the relative movement between the handle 312 and the blade unit 311 while it (i.e., the movable axis 65) is being kept perpendicular to the second pivot axis 62. In the embodiment shown in FIG. 10, when the blade unit 311 pivots about the second pivot axis 62 for following the skin contours of a user during shaving, the direction of the third axis 65 moves in response to the force applied through the relative movement transfer member 330.

In the embodiment shown in FIG. 10, the relative movement transfer member 330 includes a shaft 333 having a first end 331 inserted into an insertion hole 347 of the return force generating member 340. The insertion hole 347 of the return force generating member 340 has an opening shape which is designed to hold the first end 331 of the relative movement transfer member 30.

The second end (not shown) of the shaft 333 is fixed in the blade unit 311. The shaft 333 transfers a relative movement between the handle 312 and the blade unit 311 which is caused by the pivotal movement about the second pivot axis 62, to the return force generating member 340. The relative movement transfer member 330 (or the shaft 333) and the holes 347 are disposed along the third axis 65.

FIG. 11 is a perspective view of the return force generating member 340 shown in FIG. 9. The return force generating member 340 includes (i) a holding structure 341 (or the insertion hole 347) for holding the first end 331 of the relative movement transfer member 330, and (ii) an elastic member 342 connected to the holding structure 341 for generating the return force in response to the relative movement transfer member 330. The return force generating member 340 further includes (iii) an outer support 343. The holding structure 341 and the elastic member 342 are formed in the outer support 343. The outer support 343 includes an outer frame 345 which supports the elastic member 342. The elastic member 342 includes two elastomeric walls 346 each formed between the walls of the outer frame 345. The elastomeric walls 346 and the walls of the outer frame 345 form the holding structure 341.

The holding structure 341 can take any shape or structure which can receive the relative movement transmitted from the relative movement transfer member 330. In the embodiment shown in FIG. 11, the holding structure 341 has a rectangular-column-like shape which is formed at the center of the return force generating member 340 and has dimensions suitable for holding the first end 331 of the relative movement transfer member 330 by insertion.

Figure 12:
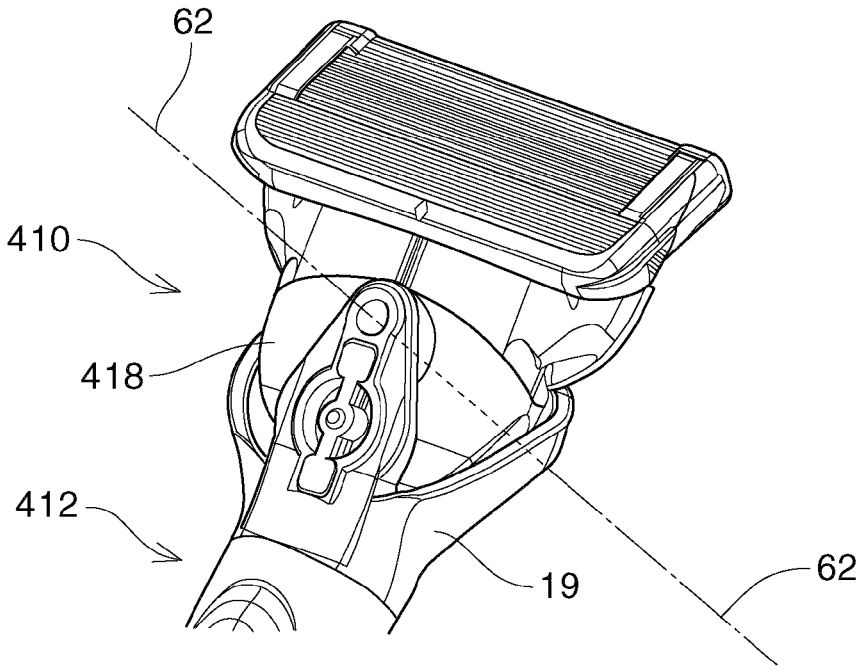
FIG. 12 is a perspective view of a safety razor which is yet another embodiment of the present invention.
Figure 13:
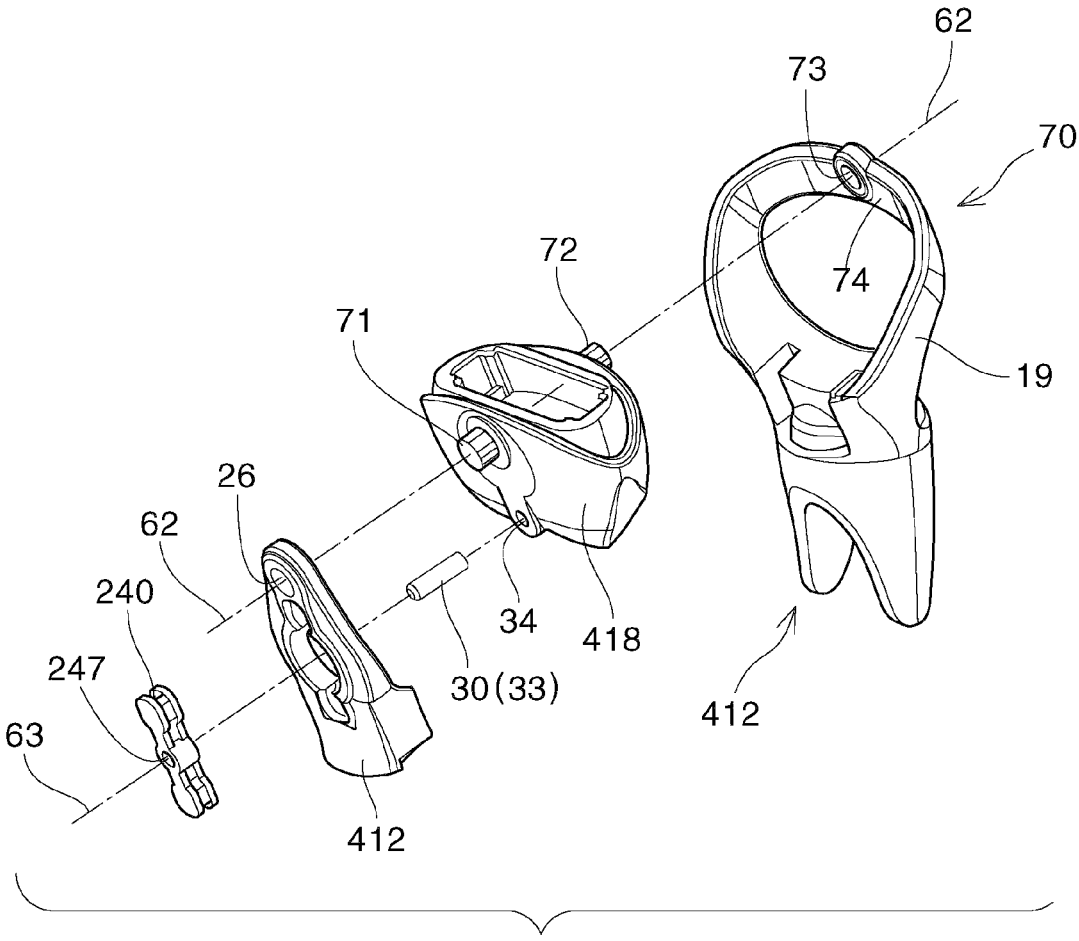
FIG. 13 is an exploded perspective view of a subassembly of the safety razor shown in FIG. 12.

FIGS. 12-13 show a still another embodiment (i.e., a safety razor 410) of the safety razor of the invention. Referring to FIG. 12, this safety razor 410 is similar to the safety razor 210 shown in FIG. 8 but different in the structure (or the mechanism) relating to the connecting member. Specifically, the safety razor 410 includes a support member 19 which is connected to and extends from the handle 412, and a modified connecting member 418.

FIG. 13 is an exploded perspective view of a subassembly of the safety razor 410 shown in FIG. 12. Referring to FIG. 13, the support member 19 includes a closed ring-like shape 70 which has a flattened portion 74. The support member 70 has a hole 73 formed in the flattened portion 74. The modified connecting member 418 has two projections 71 and 72 extending opposing directions one another along the second axis 62. The projection 71 is inserted into the hole 26 formed in the handle 412. The hole 73 has an appropriate size and shape so that the projection 72 can be inserted therein. As shown in FIG. 13, the central axes of the holes 26 and 73 and the two projections 71 and 72 are disposed along the second axis 62 such that the connecting member 418 and the handle 412 can be connected for a pivotal movement about the second pivot axis 62.

Similarly to the subassembly shown in FIG. 2, the relative movement transfer member 30 includes a shaft 33 having a first end 31 inserted into a hole 247 of the return force generating member 240 and a second end 32 inserted into a hole 34 of the blade unit 11. The hole 247 of the return force generating member 240 has an opening shape which is designed to hold the first end 31 of the relative movement transfer member 30. The shaft 33 transfers a relative movement between the handle 412 and the blade unit 11 which is caused by the pivotal movement about the second pivot axis 62, to the return force generating member 240. The relative movement transfer member 30 (or the shaft 33) and the holes 34 and 247 are disposed along the third axis 63 which is parallel to the second axis 62.

In the embodiment shown in FIGS. 12-13, the support member 19 of the safety razor 410 extends from the handle 412 and holds the connecting member 418 between the handle 412 and the support member 19. Since the safety razor 410 includes the support member 19 which supports or holds the connecting member 418, the structure of the safety razor 410 can be protected from damage which might be caused by an excess force which may be applied by a user during shaving. In addition, compared to the other embodiments discussed above (e.g., that shown in FIG. 2), since the safety razor 410 does not need the attachment member 16 and the pins 21 and 25 which are disposed along the second axis 62, the structure of the connecting member 418 as well as the manufacturing process of the safety razor 410 can be simplified.

Figure 14:
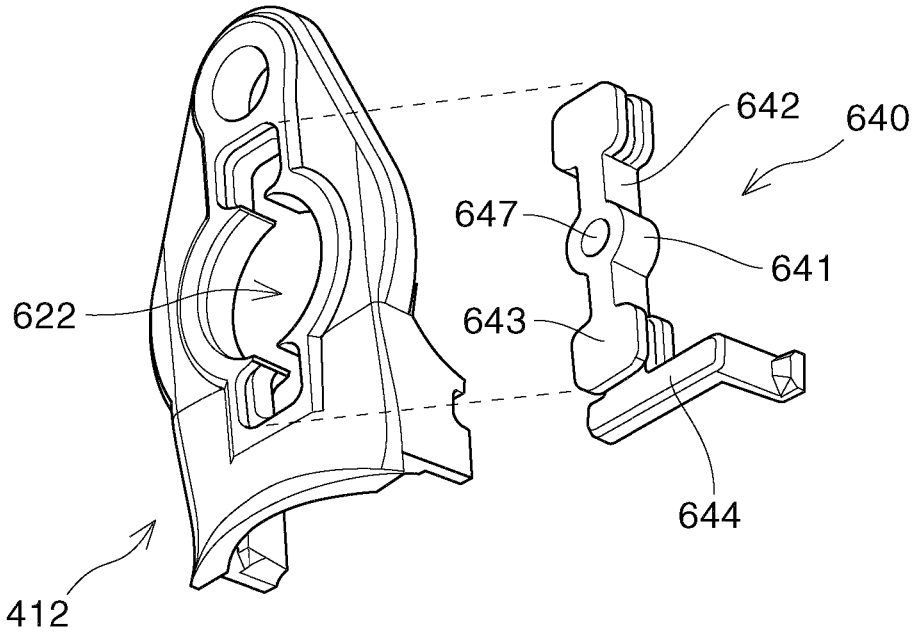
FIG. 14 is an exploded perspective view of another subassembly of a safety razor which is a still another embodiment of the present invention.
Figure 15:
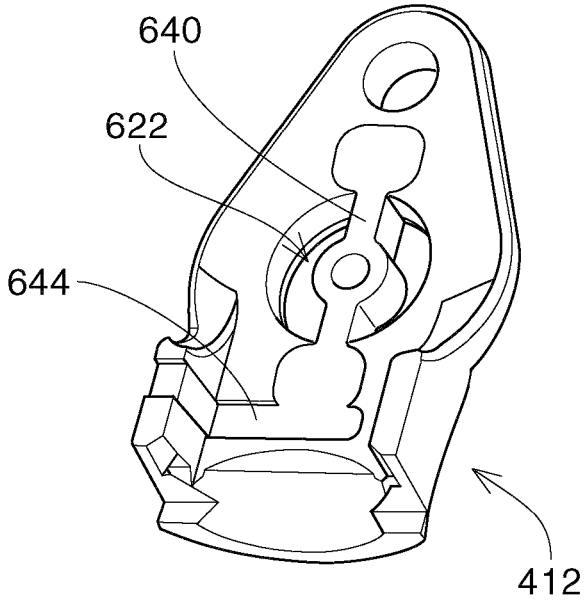
FIG. 15 is a perspective view of the subassembly shown in FIG. 14.

FIG. 14 is an exploded_perspective view of a subassembly of a safety razor which is a still another embodiment of the present invention. FIG. 15 is a perspective view of the subassembly shown in FIG. 14 looking from the direction which is opposite from that in FIG. 14. In the embodiment shown in FIGS. 14 and 15, a return force generating member 640 is formed in the concave portion 622 of the handle 412.

The return force generating member 640 includes (i) a holding structure 641 having a round hole 647, (ii) an elastic member 642 connected to the holding structure 641, (iii) an outer support 643; and (iv) an attachment arm 644. The attachment arm 644 extends from the outer support 643 and fixes the return force generating member 640 to the handle 412 as shown in FIG. 15. In this embodiment, all the elements 641-644 of the return force generating member 640 are formed by an identical elastomeric material. Alternatively, if desired, the elements 641-644 can be formed by a different elastomeric material(s).

Figure 16:
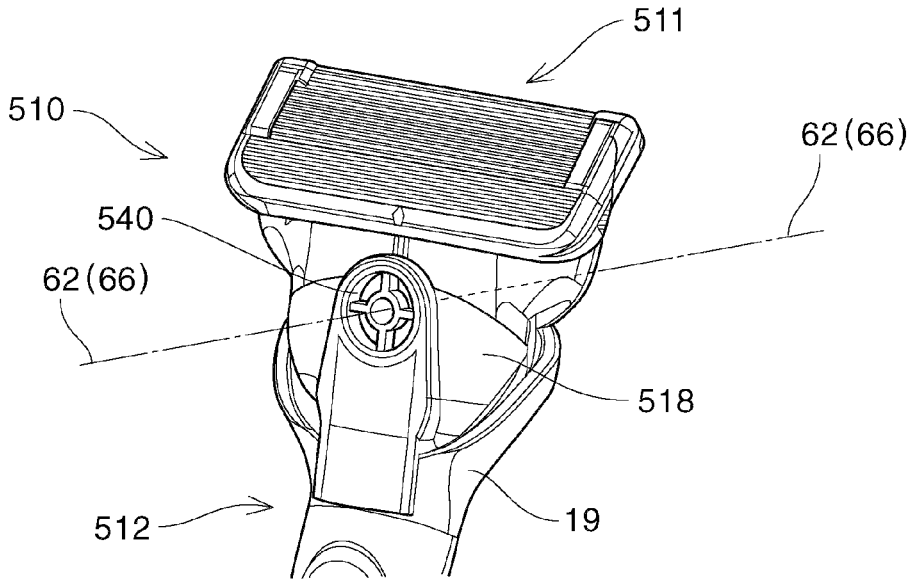
FIG. 16 is a perspective view of a safety razor which is yet another embodiment of the present invention.
Figure 17:
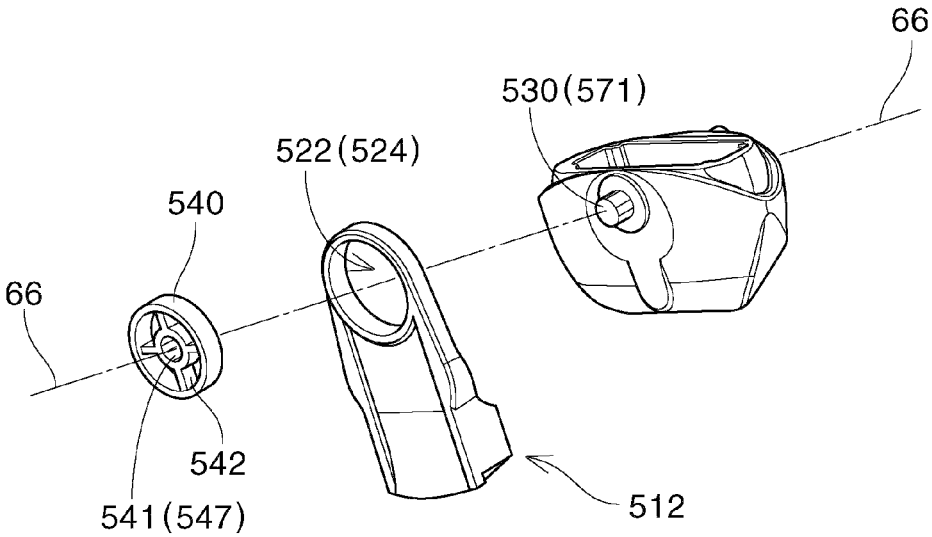
FIG. 17 is an exploded perspective view of a subassembly of the safety razor shown in FIG. 16.
Figure 18:
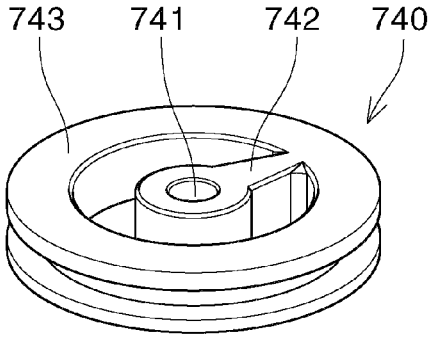
FIGS. 18-24 are a perspective view of a return force generating member which can used in other embodiments of the invention.
Figure 19:
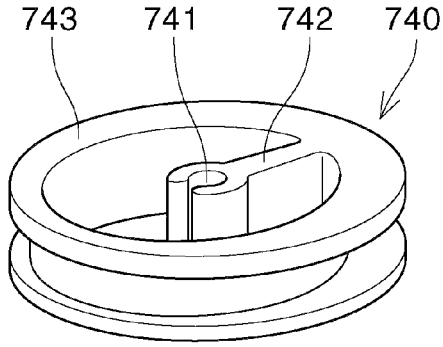
Figure 20:
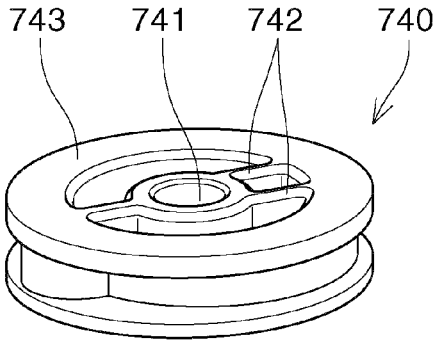
Figure 21:
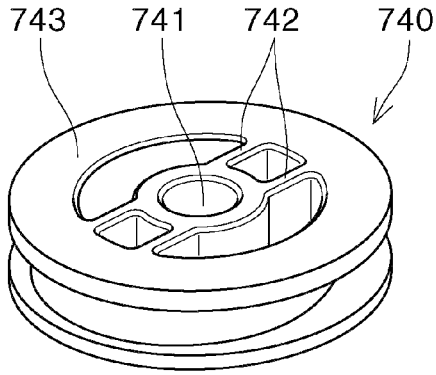
Figure 22:
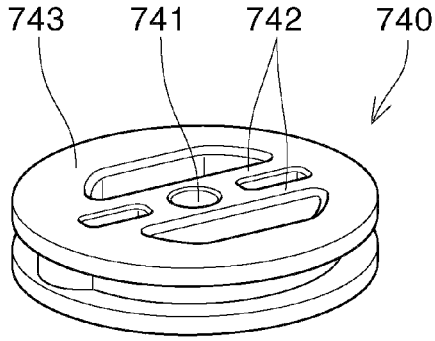
Figure 23:
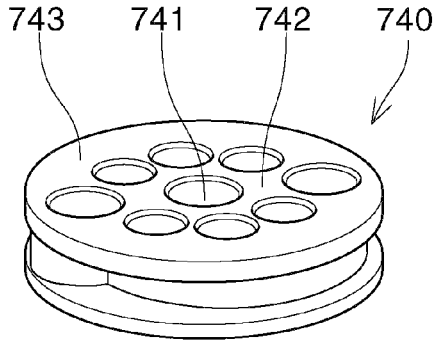
Figure 24:
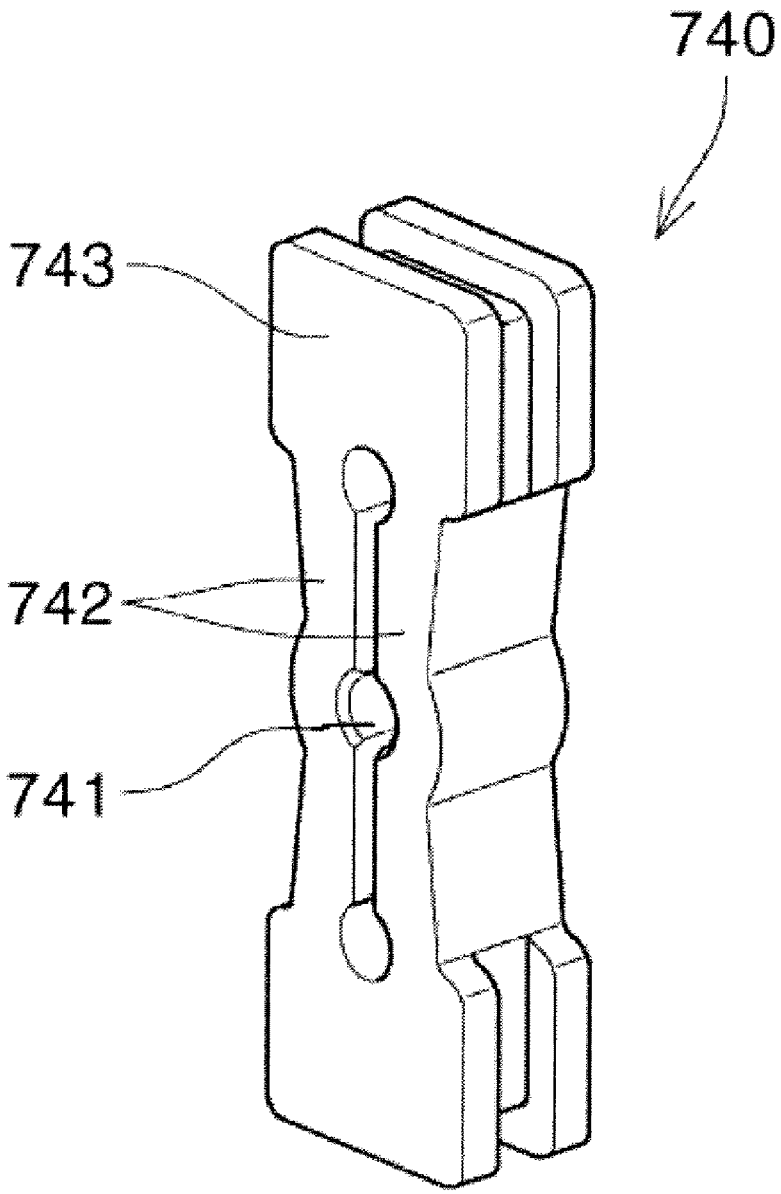

FIGS. 16-17 show yet another embodiment (i.e., a safety razor 510) of the safety razor of the invention. This safety razor 510 is different from the safety razor 410 shown in FIGS. 12 and 13 in the structure (or the mechanism) relating to the relative movement transfer member and the return force generating member. Referring to FIG. 16, the safety razor 510 includes a blade unit 511 and a handle 512 which are connected through a connecting member 518.

FIG. 17 is an exploded_perspective view of a subassembly of the safety razor 510 shown in FIG. 16. Referring to FIG. 17, the handle 512 has a concave portion 522 (i.e., a hole 524 in this embodiment) formed on its surface. The safety razor 510 includes a return force generating member 540 formed in the concave portion 522 for generating a return force for the blade unit 511. The return force generating member 540 has a central axis 66 which coincides with the second axis 62 shown in FIG. 16.

Compared with the safety razor 410 shown in FIGS. 12 and 13, the structure of the safety razor 510 shown in FIGS. 16-17 is simpler in that the central axis 66 of the return force generating member 540 coincides with the second pivot axis 62.

The safety razor 510 further includes a relative movement transfer member 530 formed between the blade unit 511 and the handle 512 for transferring a relative movement between the blade unit 511 and the handle 512 caused by the pivotal movement.

The return force generating member 540 includes (i) a holding structure 541 having a round hole 547 for holding a part of the relative movement transfer member 530, and (ii) an elastic member 542 connected to the holding structure 541 for generating the return force in response to the relative movement transfer member 530. The relative movement transfer member 530 includes a projection 571 formed on the axis 66 (i.e., the projection 571 has a central axis (not shown) which coincides with the axis 66). The projection 571 transfers the relative movement between the blade unit 511 and the handle 512 by rotational angle about the central axis 66.

For an effective operation, the outer surface of the return force generating member 540 is fixed to the inner surface of the hole 524, while the outer surface of the relative movement transfer member 530 is fixed to the inner surface of the hole 547 of the holding structure 541. These fixing structures can be implemented by applying an adhesive between the surfaces. Alternatively, these fixing structures can be implemented without such an application of adhesive if the related elements are so precisely designed and manufactured that the surfaces can generate enough friction which prevents slide between the surfaces.

In operation, when the blade unit 511 pivots about the pivot axis 62 for following the skin contours of a user during shaving, the projection 571 (i.e., the relative movement transfer member 530) rotates about the pivot axis 62 in response to the force applied through the relative movement transfer member 530. In other words, the relative movement transfer member 530 is formed on the second axis 62 for transferring the relative movement which is given by a rotation angle difference about the second axis 62.

The rotation angle produces a strain at the elastic member 542 of the return force generating member 540. The return force generating member 540 generates a return force which tries to move the blade unit 511 to the rest position. In other words, the return force generating member 540 is formed on the second axis 62 for generating the return force which is given by a torque about the second axis 62.

Figure 25:
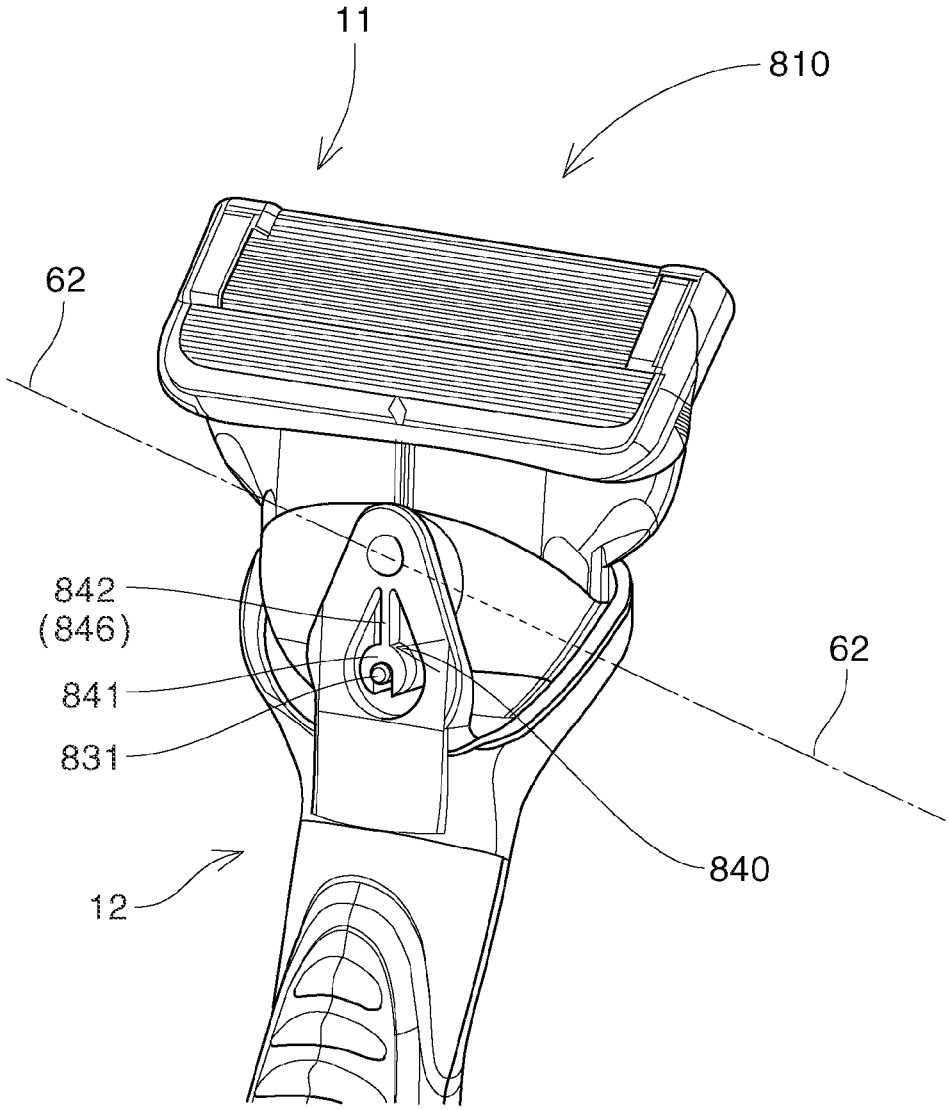
FIG. 25 is a perspective view of a safety razor which is yet another embodiment of the present invention.

FIG. 25 is a perspective view of a safety razor 810 which is yet another embodiment of the present invention. In this embodiment, a return force generating member 840 is formed by an identical material with that employed by the handle 12. Specifically, the return force generating member 840 is formed by (or includes) an extended material from that employed in a part of the handle 12. The return force generating member 840 includes (i) a holding structure 841 for holding the end 831 of the relative movement transfer member 30 (not shown in FIG. 25), and (ii) an elastic member 842 connected to the holding structure 841 for generating the return force in response to the relative movement transfer member 30.

The elastic member 842 includes an elastomeric element (or bar) 846 formed by an integral plastic molding which is used for producing the handle 12 in the manufacturing process. In other words, the elastomeric element 846 is formed by the same manufacturing process (and at the same time) as that for producing the handle 12. This is beneficial since this embodiment does not require a return force generating member which is produced by a separate manufacturing process from that used for producing the handle 12. In addition, since the elastic member 842 is integral with the handle 12, the assembling process for connecting the blade unit 11 to the handle 12 can be simplified.

Modifications to the described embodiments are of course possible without departing from the principles of the invention. It is to be understood, therefore, that the specifically described embodiments are given by way of non limiting example only and it is intended that the invention should be limited only by the claims which follow.

The dimensions and values disclosed herein are not to be understood as being strictly limited to the exact numerical values recited. Instead, unless otherwise specified, each such dimension is intended to mean both the recited value and a functionally equivalent range surrounding that value. For example, a dimension disclosed as "40 mm" is intended to mean "about 40 mm."

Every document cited herein, including any cross referenced or related patent or application, is hereby incorporated herein by reference in its entirety unless expressly excluded or otherwise limited. The citation of any document is not an admission that it is prior art with respect to any invention disclosed or claimed herein or that it alone, or in any combination with any other reference or references, teaches, suggests or discloses any such invention. Further, to the extent that any meaning or definition of a term in this document conflicts with any meaning or definition of the same term in a document incorporated by reference, the meaning or definition assigned to that term in this document shall govern.

While particular embodiments of the present invention have been illustrated and described, it would be obvious to those skilled in the art that various other changes and modifications can be made without departing from the spirit and scope of the invention. It is therefore intended to cover in the appended claims all such changes and modifications that are within the scope of this invention.

What is claimed is:

1. A safety razor comprising a handle having a handle axis and a blade unit having at least one blade, the blade unit being connected to the handle for a pivotal movement relative thereto about a perpendicular pivot axis substantially perpendicular to the handle axis and the at least one blade for following the skin contours of a user during shaving, the blade unit having a rest position towards which the blade unit is biased by a return force when pivoted about the perpendicular pivot axis away from the rest position, one of the handle and the blade unit having a concave portion formed on its surface, the safety razor further comprising:

(a) a relative movement transfer member formed between the handle and the blade unit for transferring a relative movement between the handle and the blade unit caused by the pivotal movement, and (b) a return force generating member formed in the concave portion for generating a return force for the blade unit in response to the relative movement transfer member, wherein the return force generating member includes (i) a holding structure for holding a part of the relative movement transfer member, and (ii) an elastic member connected to the holding structure for generating the return force in response to the relative movement transfer member, wherein the relative movement transfer member has a movable axis which moves in response to the relative movement between the handle and the blade unit while being kept parallel to the perpendicular pivot axis.

2. The safety razor according to claim 1, wherein the return force generating member further includes (iii) an outer support formed in the concave portion, and wherein the holding structure and the elastic member are formed in the outer support.

3. The safety razor according to claim 2, wherein the outer support includes an outer frame formed in the concave portion for supporting the elastic member, and the elastic member includes at least one elastomeric element formed between the outer frame and the holding structure.

4. The safety razor according to claim 1, wherein the return force generating member is formed by an identical material with that employed by the handle.

5. The safety razor according to claim 1, wherein the relative movement transfer member includes a rod-like shaped member which couples the handle to the blade unit.

6. The safety razor according to claim 5, wherein the holding structure has a hole such that a part of the rod-like shaped member can be inserted.

7. The safety razor according to claim 5, wherein the holding structure has a rectangular-column-like shape such that a part of the rod-like shaped member can be inserted.

8. The safety razor according to claim 1, wherein the concave portion includes a hole formed in the one of the handle and the blade unit which penetrates its surfaces.

9. The safety razor according to claim 1, wherein the blade unit is connected to the handle for movement relative thereto about a parallel pivot axis which is substantially parallel to the at least one blade.

10. The safety razor according to claim 1, wherein the concave portion is formed on the surface of the handle.

11. The safety razor according to claim 1, wherein the blade unit includes a connecting member which connects the blade unit to the handle for the pivotal movement about the perpendicular pivot axis, and wherein the safety razor further comprises a supporting member connected to the handle for supporting the connecting member thereby protecting the safety razor from being damaged by an excess force which can be applied by a user during shaving.

* * * * *